US011667052B2

(12) United States Patent
Olsen

(10) Patent No.: US 11,667,052 B2
(45) Date of Patent: Jun. 6, 2023

(54) TIMBER PROCESSING SYSTEM AND METHOD

(71) Applicant: Kelly J. Olsen, Duluth, MN (US)

(72) Inventor: Kelly J. Olsen, Duluth, MN (US)

( * ) Notice: Subject to any disclaimer, the term of this patent is extended or adjusted under 35 U.S.C. 154(b) by 931 days.

(21) Appl. No.: 16/561,928

(22) Filed: Sep. 5, 2019

(65) Prior Publication Data

US 2020/0070380 A1 Mar. 5, 2020

Related U.S. Application Data

(60) Provisional application No. 62/727,505, filed on Sep. 5, 2018.

(51) Int. Cl.

| | |
|---|---|
| ***B27B 1/00*** | (2006.01) |
| ***B27B 31/00*** | (2006.01) |
| ***B27B 29/00*** | (2006.01) |
| ***B27B 17/00*** | (2006.01) |

(52) U.S. Cl.

CPC ..... *B27B 1/002* (2013.01); *B27B 1/005* (2013.01); *B27B 17/0091* (2013.01); *B27B 29/00* (2013.01); *B27B 31/006* (2013.01)

(58) Field of Classification Search

CPC ..... B27B 1/002; B27B 1/005; B27B 17/0091; B27B 29/00; B27B 29/04; B27B 29/06; B27B 31/006; B27B 31/00; B27B 31/02; B27L 7/00; B27L 7/06; A01G 23/003; A01G 23/066

See application file for complete search history.

(56) References Cited

U.S. PATENT DOCUMENTS

| | | | | |
|---|---|---|---|---|
| 3,254,686 | A * | 6/1966 | Boyd | B27B 17/0091 144/34.2 |
| 4,160,470 | A * | 7/1979 | Sigmund | B27L 7/00 144/392 |
| 4,284,112 | A * | 8/1981 | Hoskin | B27B 17/0058 144/195.1 |
| 4,373,564 | A * | 2/1983 | Heikkinen | B27L 7/00 144/366 |
| 4,398,581 | A * | 8/1983 | Aikins | B27L 7/00 144/195.1 |
| 7,228,881 | B1 * | 6/2007 | Smith | B27M 1/08 144/193.1 |
| 7,669,618 | B1 | 3/2010 | Halverson | |
| 2004/0168568 | A1 * | 9/2004 | Roy | A01G 23/003 92/120 |

FOREIGN PATENT DOCUMENTS

| | | | | |
|---|---|---|---|---|
| EP | 2639026 | A1 * | 9/2013 | B27L 7/00 |
| FR | 2796327 | A1 * | 1/2001 | B27L 7/00 |
| WO | WO-9937136 | A1 * | 7/1999 | A01G 23/003 |

OTHER PUBLICATIONS

Model 3040XP2 Firewood Processor (brochure), Multitek North America LLC, Aug. 2007.

* cited by examiner

*Primary Examiner* — Shelley M Self
*Assistant Examiner* — Jared O Brown
(74) *Attorney, Agent, or Firm* — Uradnik Law Firm PC

(57) ABSTRACT

A timber processing system includes a frame including a mount for attaching to a skid steer, tractor, excavator, or the like; and a grapple attached to the frame for moving timber pieces into place for cutting by a saw.

12 Claims, 6 Drawing Sheets

TIMBER PROCESSING SYSTEM AND METHOD

RELATED APPLICATIONS

This application is related to and claims priority from U.S. provisional patent application Ser. No. 62/727,505 filed Sep. 5, 2018, entitled Timber Processing System and Method, which is hereby incorporated by reference herein for all purposes.

FIELD OF THE DISCLOSURE

The invention relates generally to system and method for processing timber, and more specifically, to a skid steer, tractor, excavator, or other similar machine attachment for cutting and/or splitting timber pieces into desired sizes.

BACKGROUND

A number of systems exist that may be used to process timber. By way of example only, chain saws may be used to cut a log into desired lengths, and log splitters may be used to split the cut logs into desired sizes. However, such systems for processing timber are not without their drawbacks. Many systems cannot handle both short pieces of logs and long logs up to tree length. Many systems do not work well with crooked logs. And, many systems do not allow logs to be picked up from any angle, e.g., from an uneven pile of logs. Thus, there remains a need for an improved system and method for processing timber.

SUMMARY

The present disclosure provides a system and method for processing timber. A grapple may be used to load logs into position for cutting. Logs may be front-loaded or side-loaded. A splitter may be provided for splitting the cut pieces into manageable sizes.

Other benefits and advantages of the present disclosure will be appreciated from the following detailed description.

DESCRIPTION OF THE DRAWINGS

Exemplary embodiments of an exemplary system and method for timber processing are shown in the accompanying drawings.

DETAILED DESCRIPTION

Embodiments of the invention and various alternatives are described. Those skilled in the art will recognize, given the teachings herein, that numerous alternatives and equivalents exist which do not depart from the invention. It is therefore intended that the invention not be limited by the description set forth herein or below.

One or more specific embodiments of the system and method will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Further, for clarity and convenience only, and without limitation, the disclosure (including the drawings) sets forth exemplary representations of only certain aspects of events and/or circumstances related to this disclosure. Those skilled in the art will recognize, given the teachings herein, additional such aspects, events and/or circumstances related to this disclosure, e.g., additional elements of the devices described; events occurring related to timber processing; etc. Such aspects related to this disclosure do not depart from the invention, and it is therefore intended that the invention not be limited by the certain aspects set forth of the events and circumstances related to this disclosure.

Figure 1:
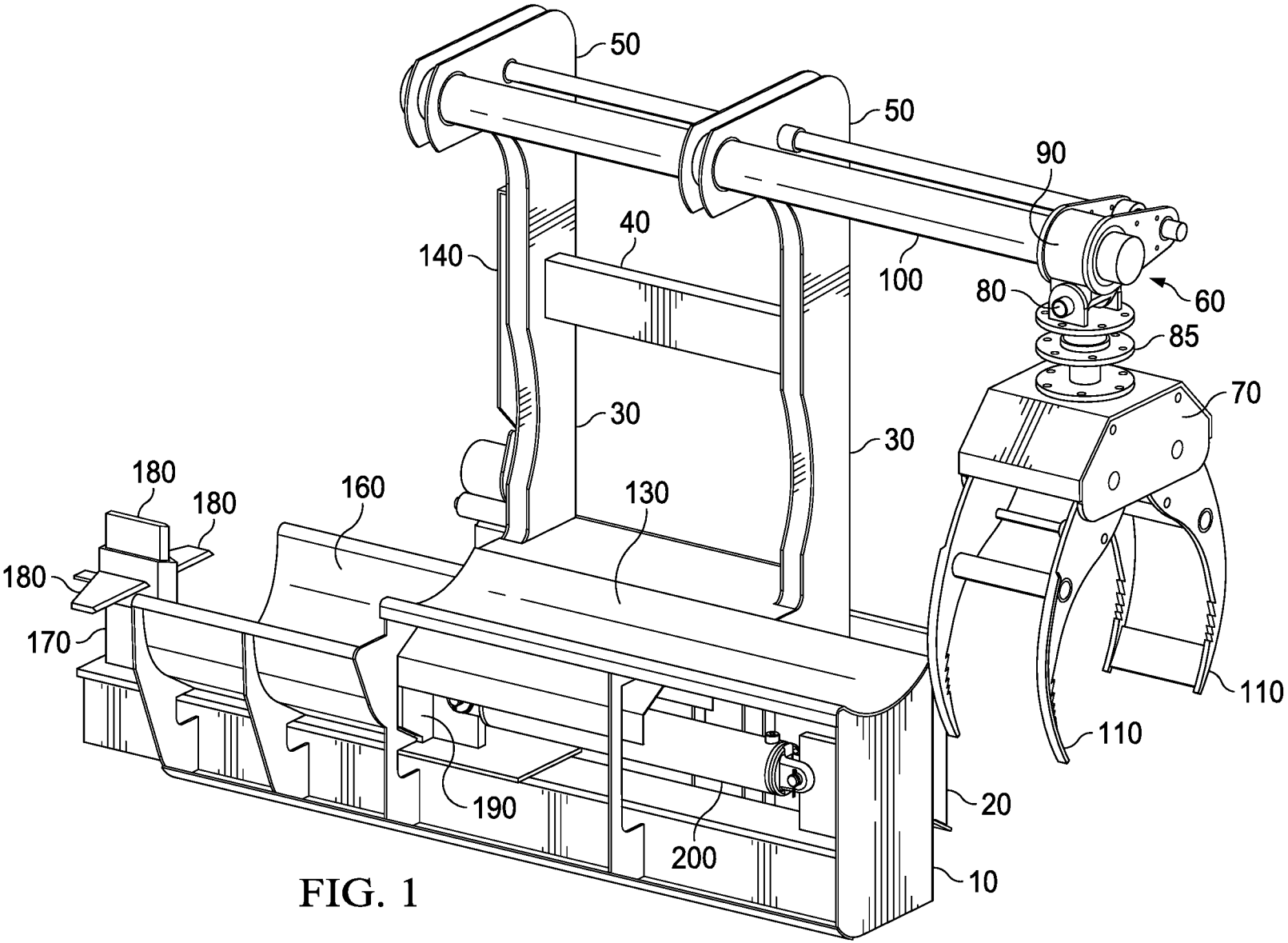
FIG. 1 is a perspective view of an exemplary embodiment of a timber processing system for side-loading logs for processing.
Figure 2:
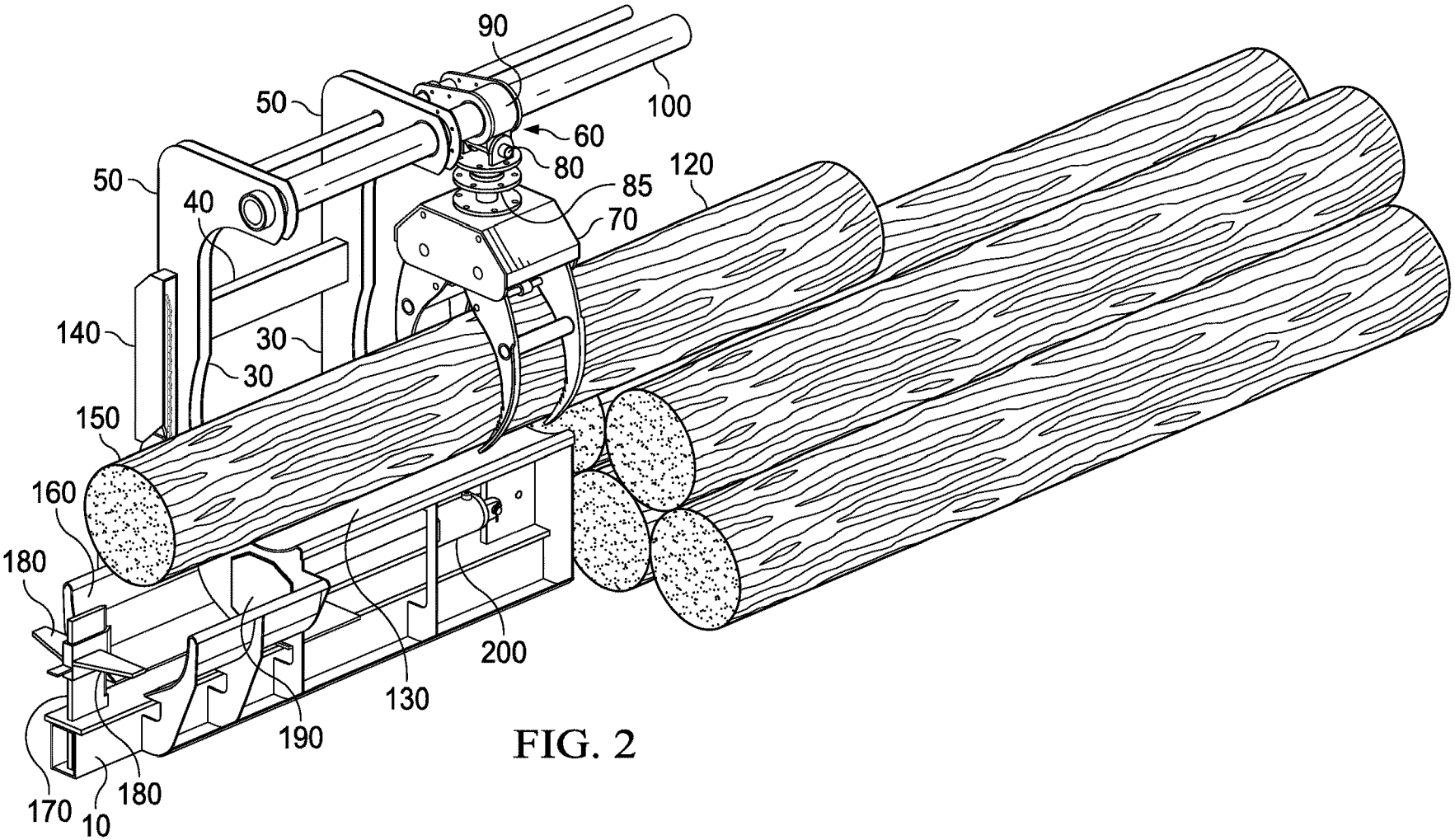
FIG. 2 is a perspective view of the exemplary embodiment of the timber processing system shown in FIG. 1, showing side-loading of a log.

Turning now to the drawings, an exemplary system and method for side-loading timber for processing is shown in FIGS. 1-2, and an exemplary system and method for front-loading timber for processing is shown in FIGS. 3-6. The system comprises an attachment for a machine such as a skid steer, tractor, excavator, etc. The system includes a frame 10 including a mount plate 20 for attaching to the machine. The mount plate 20 may be positioned at a lower back portion of the frame 10.

The frame 10 may include one or more generally upwardly extending arms 30 with one or more cross pieces 40 for support. The arms 30 include at their upper end forwardly extending cantilever portions 50. The cantilever portions 50 may support a slide assembly 60. A grapple 70 may be attached to the slide assembly 60. In one embodiment, the grapple 70 by action of the slide assembly 60 may move back and forth between right-most and left-most positions. The grapple 70 also may assume intermediate positions between the right-most and left-most positions.

The grapple 70 may be mounted to the slide assembly using pivot points 80 that allow the grapple 70 to move or swing front to back and left to right relative to the slide assembly 60 connection point and/or the longitudinal axis of the slide assembly. In another embodiment, the left/right swing may be limited. The grapple 70 also may be mounted using a rotator 85, which allows the grapple to rotate along an axis generally perpendicular to the longitudinal axis of the slide assembly.

The slide assembly 60 may comprise a slider 90 which moves along a slide track 100 along the longitudinal axis of the slide assembly 60. The slider 90 may be coupled to the grapple 70 and to a hydraulic cylinder to promote movement of the slider 90 along the longitudinal axis of the slide assembly 60. In one embodiment, the slide track 100 comprises the inside portion of a square or round tube. Of course, other configurations of slide tracks 100 may be used. Also, alternatives to a hydraulic cylinder may be used to promote slider 90 movement, e.g., a chain and sprocket, a hydraulic motor and chain, a motorized winch/drum and cable, etc.

For the side-loading embodiment, the grapple 70 generally hangs downward from the slide assembly to one side of the arms 30. See FIGS. 1-2. For the front-loading embodiment, the grapple 70 generally hangs downward from the slide assembly between the arms 30. The grapple includes a pair of claws 110 that may surround and hold at least a portion of a timber piece 120 to be processed.

The lower portion of the frame 10 may include an area in which timber logs may be cut and split into pieces of desired sizes. The lower portion may include a log holding trough 130 extending generally parallel to the slide assembly 60. The grapple 70 may be used to place and hold a log 120 in the trough 130. At one end of the trough 130 a saw 140 may be mounted to the frame 10 or arm 30. A portion 150 of a log 120 extending beyond the trough 130 proximate the saw 140 may be cut off by the saw 140. The saw 140 may be a chain saw, a saw blade, a shear, etc.

In operation, the cut off log portion 150 may fall into a second trough 160 (or on the ground if no splitting is required). The second trough 160 includes at a first end a splitting wedge 170 having one or more blades or edges 180 that may be used to split a log piece 150 along its length, e.g., into quarters, halves, etc. At the end of the second trough 160 opposite the first end a push plate 190 may be provided for urging the log piece 150 against the blades or edges 180. In one embodiment, a hydraulic cylinder 200 is used to move the push plate 190 during a splitting operation. The splitting wedge 170 may be adjusted upward, downward, or into any desired position. In one embodiment the splitting wedge 170 may be adjusted by operation of one or more hydraulic cylinders coupled to the splitting wedge 170. In another embodiment, the splitting wedge 170 is moved manually and then pinned in place. In another embodiment, the splitting wedge 170 may be adjusted by contacting the bottom portion of the splitting wedge with the ground, and then moving the frame 10 up or down relative to the splitting wedge 170.

The grapple 70 may hold a log while a portion 150 of it is being cut by the saw 140. Then, the grapple 70 may be used to slide the log so that another portion of the log extends beyond the end of the log holding trough 130, so that the log may be cut again by the saw 140. In that way, an entire timber portion to be processed may be cut into desired lengths by the saw 140.

In one embodiment, the push plate 190 moves in conjunction with movement of the slider 90. In that way, a cut log piece is split as the remaining portion of the log is advanced into position for another cut by the saw 140. In another embodiment, the push plate 190 and slider 90 may move independently of one another.

Figure 3:
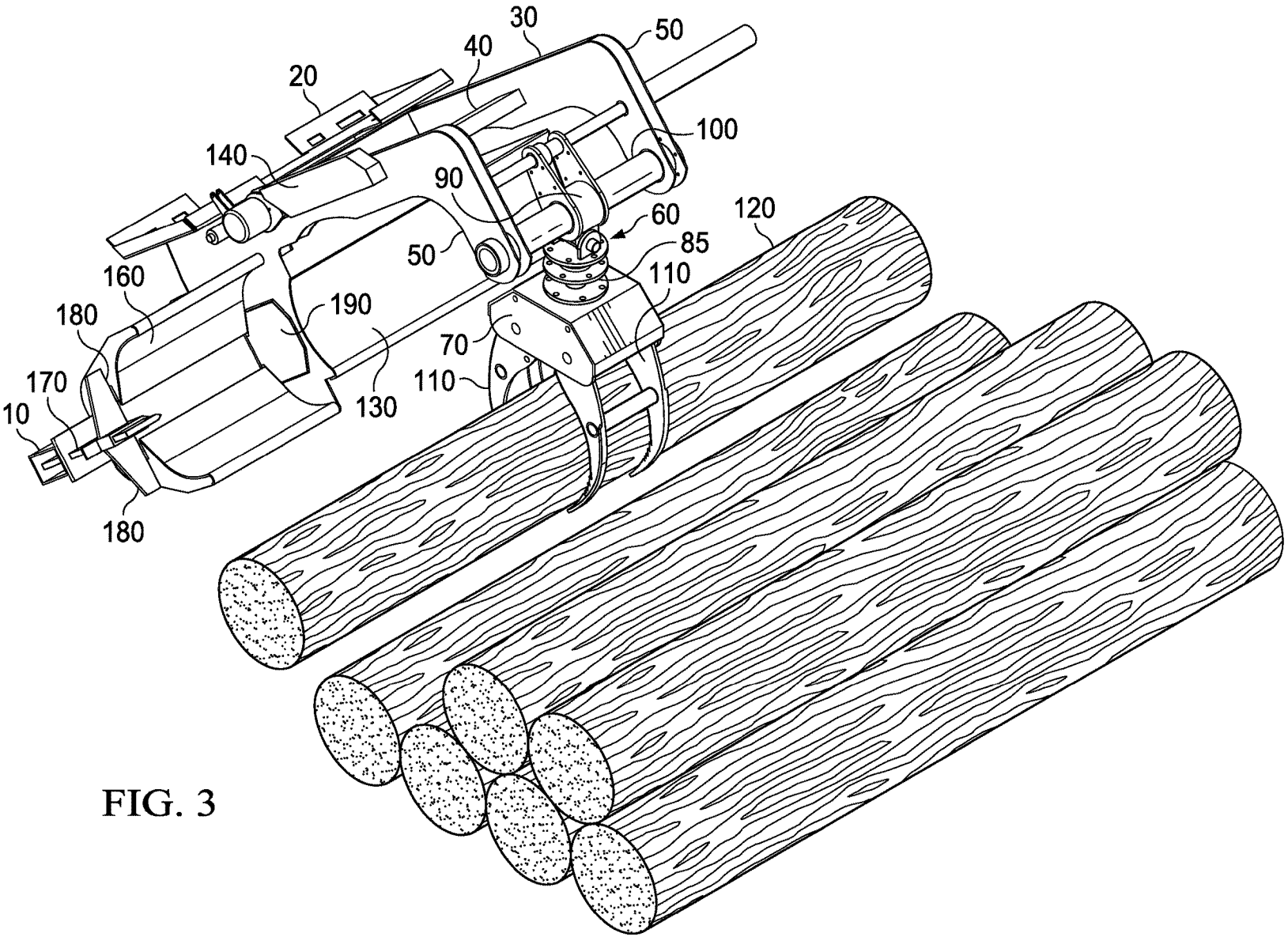
FIG. 3 is a perspective view of another exemplary embodiment of a timber processing system for front-loading logs for processing.
Figure 4:
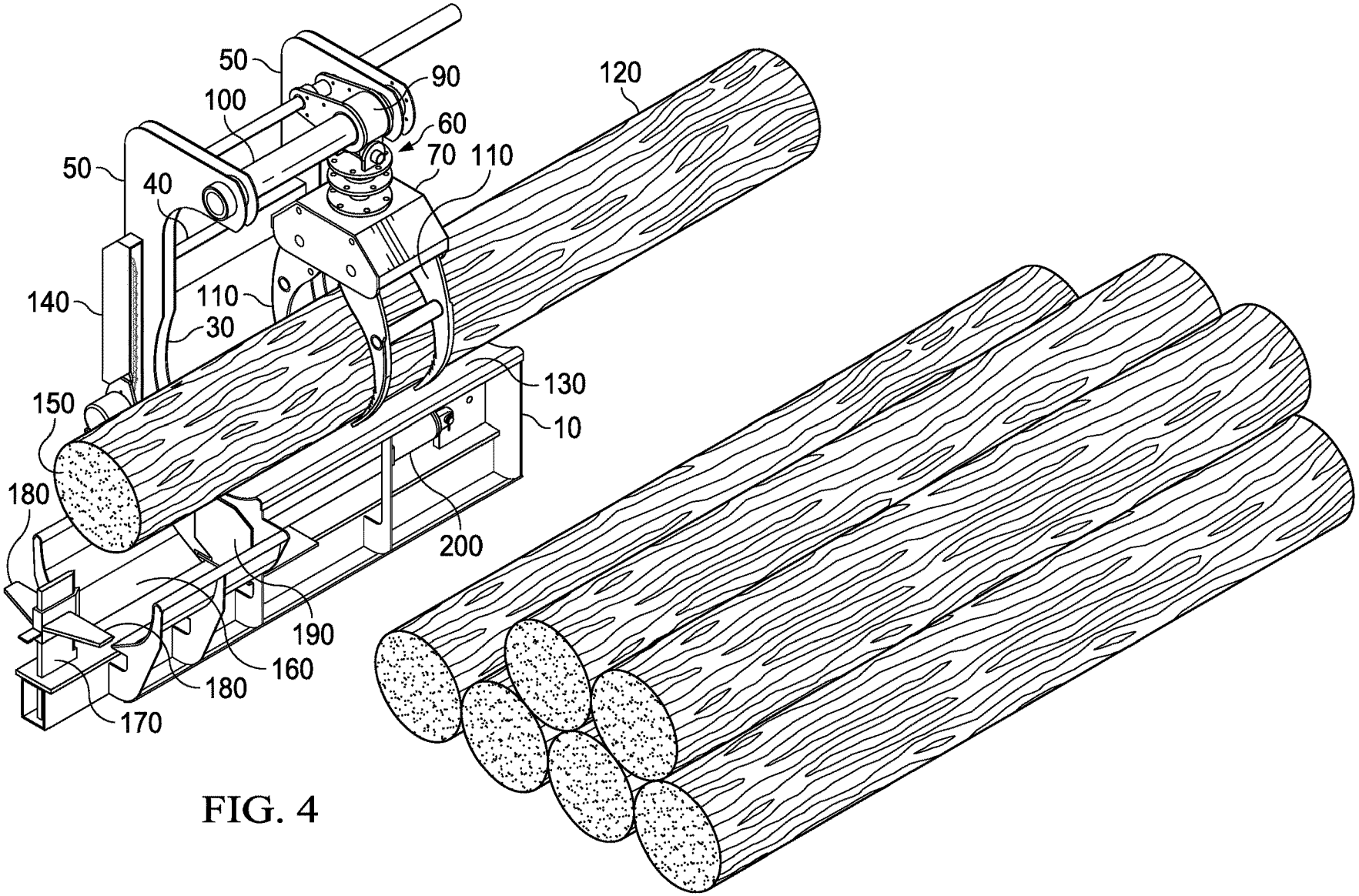
FIG. 4 is a perspective view of the exemplary embodiment of the timber processing system shown in FIG. 3, showing a front-loaded log.
Figure 5:
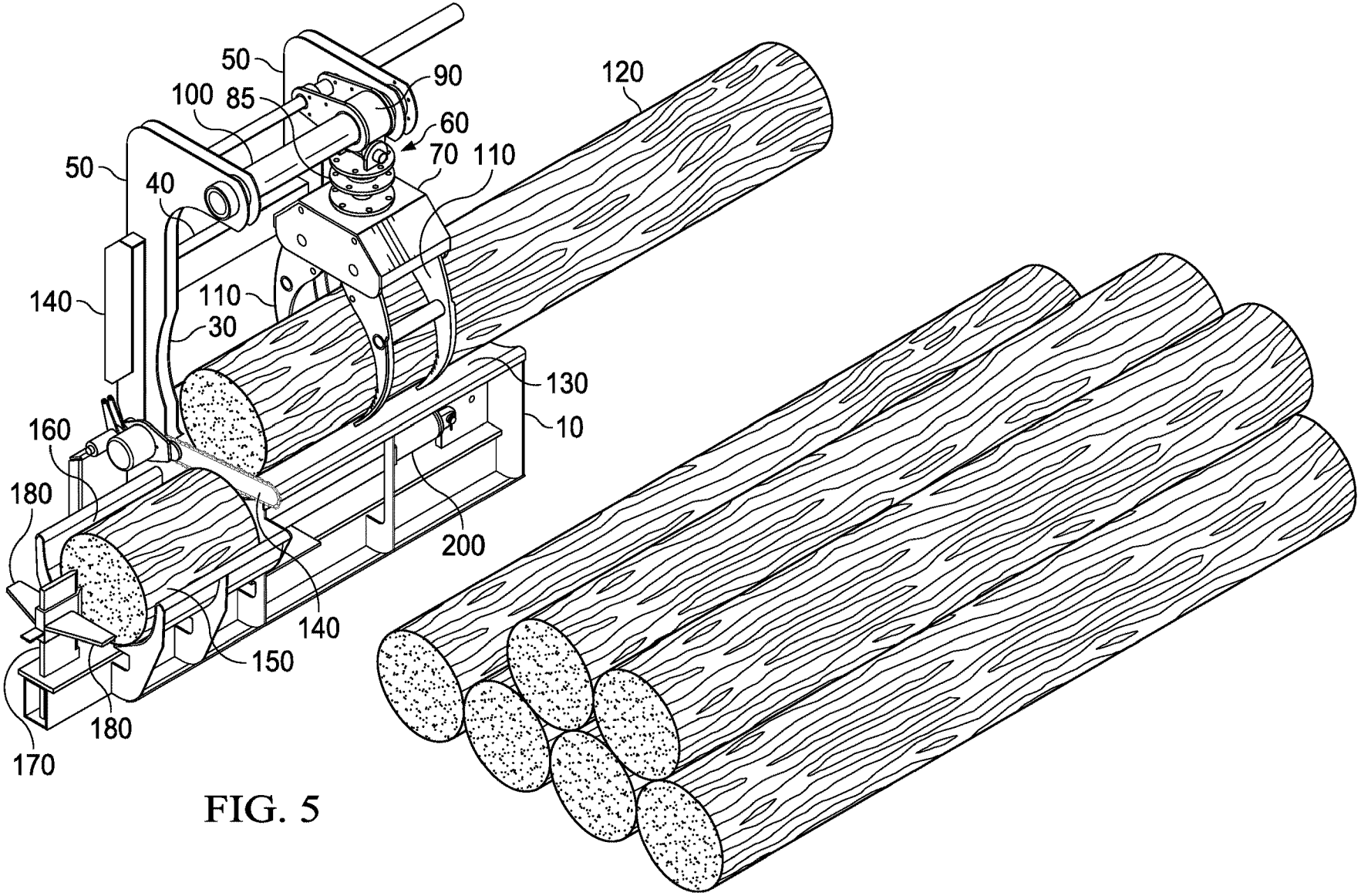
FIG. 5 is a perspective view of the exemplary embodiment of the timber processing system shown in FIG. 3, showing a first cut of the loaded log.
Figure 6:
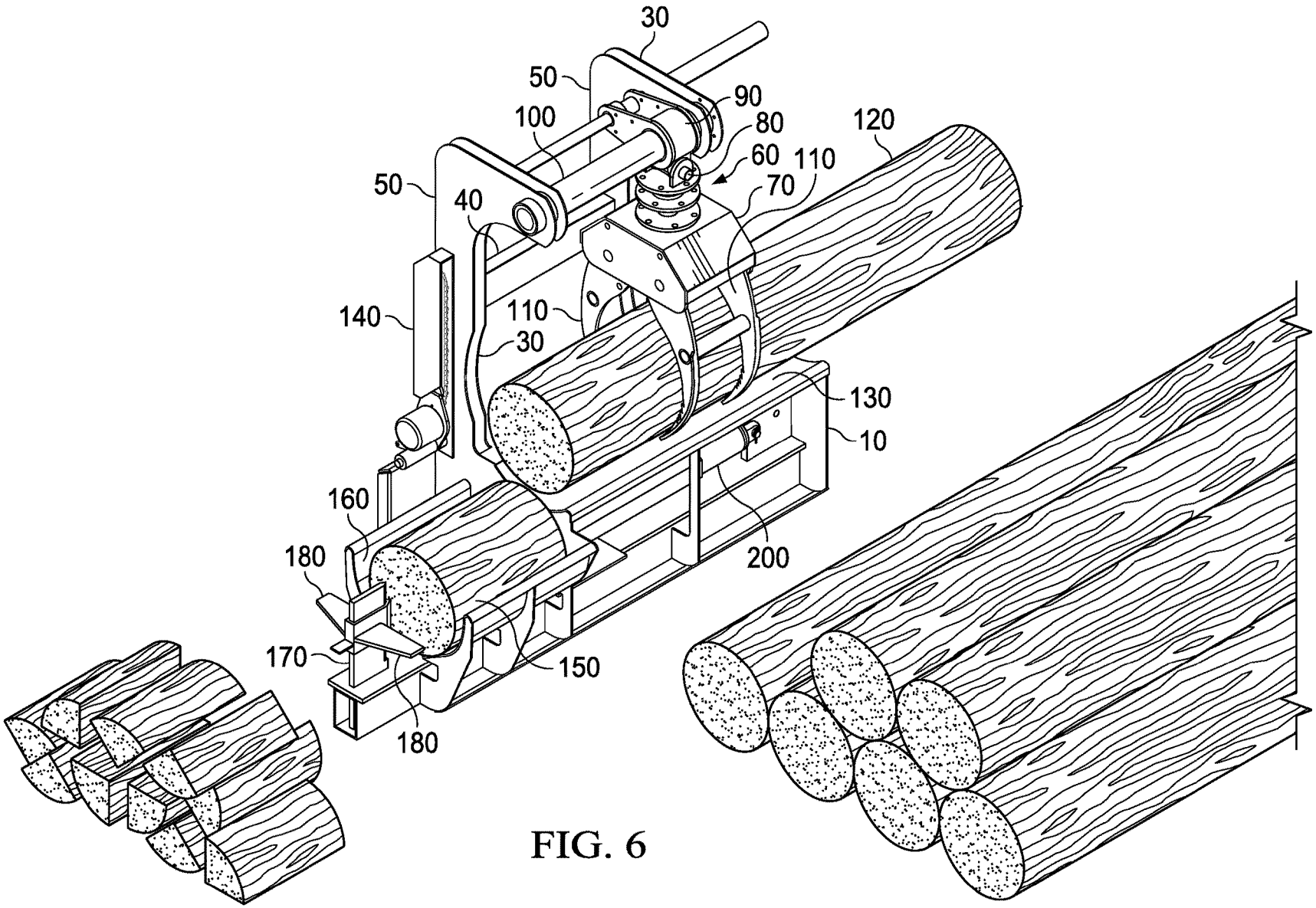
FIG. 6 is a perspective view of the exemplary embodiment of the timber processing system shown in FIG. 3, showing a subsequent cut of the loaded log.

As shown in FIG. 3, loading a log into the log holding trough 130 may be accomplished by using the skid steer or other machine to tilt the upper end of the frame 10 forward and/or downward. As the frame 10 is tilted, the grapple 70 will swing forward (outward) away from the log holding trough 130. At this point the grapple 70 may capture in its claws 110 a log positioned on the ground or in a pile in front of the skid steer or other machine. Then, the frame 10 may be tilted back, so that the grapple (holding the log) returns to a position above the log holding trough 130. See FIG. 4. In one embodiment, to permit log clearance, the forward portion of the log holding trough 130 includes a first trough side that does not extend upwardly as far as a second trough side disposed on the rearward portion of the log holding trough 130.

Other embodiments for loading logs also may be used. For example, in one embodiment the frame 10 is not tilted forward; instead, only a portion of the frame 10 coupled to the grapple 70 is moved forward and/or downwardly.

In another embodiment the log holding trough 130 may include a chain running along a portion of the trough length to aid in urging a log into a cutting position. Alternately, or in addition, the log may be urged into a cutting position by movement of the trough 130 itself. In another embodiment the grapple 70 simply loads logs into the log holding trough 130, and does not slide along the trough's length.

It should be understood that the foregoing description is only illustrative of the invention. Various alternatives and modifications can be devised by those skilled in the art having the benefit of this disclosure, without departing from the invention. Accordingly, the invention is intended to embrace all such alternatives, modifications and variances.

Certain exemplary embodiments of the disclosure may be described. Of course, the embodiments may be modified in form and content, and are not exhaustive, i.e., additional aspects of the disclosure, as well as additional embodiments, will be understood and may be set forth in view of the description herein. Further, while the invention may be susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention.

The invention claimed is:

1. A timber processing attachment for a skid steer, excavator, or tractor, the attachment including:

a frame including a pair of upwardly extending arms, wherein each arm includes at an upper end a forwardly extending cantilever portion;

a slide assembly supported by each cantilever portion, wherein the slide assembly includes a slider moveable along a longitudinal axis of the slide assembly, wherein the longitudinal axis of the slide assembly extends laterally and through forward end portions of each cantilever portion;

a mounting plate coupled to the frame for coupling the attachment to a skid steer, excavator, or tractor; and a grapple coupled to the slider, wherein the grapple is coupled to the slider by two pivots and a rotator that permit the grapple to move forward, back, left and right, and to rotate about an axis of the grapple.

2. The attachment of claim 1, including, coupled to the frame, a first trough adapted to hold a log for cutting.

3. The attachment of claim 2, wherein a forward edge of the first trough is lower in height than a rearward edge of the trough.

4. The attachment of claim 2, including a second trough coupled to the frame, the second trough positioned below a first end of the first trough so that the second trough receives a timber portion that is cut when the log held within the first trough extends beyond the first end of first trough.

5. The attachment of claim 4 including a saw coupled to the frame and located proximate the first end of the first trough.

6. The attachment of claim 5 including a splitting wedge positioned at an end of the second trough and distal from the first end of the first trough.

7. The attachment of claim 6 including a push plate for urging a timber portion received in the second trough against the splitting wedge.

8. The attachment of claim 7 wherein the push plate is coupled to a hydraulic cylinder.

9. The attachment of claim 8 wherein the push plate moves laterally in conjunction with and in the same direction of a lateral movement of the grapple.

10. The attachment of claim 8 wherein the first trough includes a chain for laterally translating a log portion toward and beyond the first end of the first trough.

11. The attachment of claim 1, wherein the slider is coupled to a hydraulic cylinder.

12. The attachment of claim 11, wherein the slide assembly includes a tubular portion within which a portion of the slide assembly moves from side to side.

* * * * *